US009698537B2

(12) United States Patent
Yokoyama et al.

(10) Patent No.: US 9,698,537 B2
(45) Date of Patent: Jul. 4, 2017

(54) CONNECTOR

(71) Applicant: JAPAN AVIATION ELECTRONICS INDUSTRY, LIMITED, Shibuya-ku, Tokyo (JP)

(72) Inventors: Yohei Yokoyama, Tokyo (JP); Masaaki Takaku, Tokyo (JP); Kouhei Ueda, Tokyo (JP); Tatsuya Shioda, Tokyo (JP); Yoshio Minegishi, Tokyo (JP)

(73) Assignee: JAPAN AVIATION ELECTRONICS INDUSTRY, LIMITED, Tokyo (JP)

( * ) Notice: Subject to any disclaimer, the term of this patent is extended or adjusted under 35 U.S.C. 154(b) by 0 days.

(21) Appl. No.: 15/307,772

(22) PCT Filed: May 18, 2015

(86) PCT No.: PCT/JP2015/064171
§ 371 (c)(1),
(2) Date: Oct. 28, 2016

(87) PCT Pub. No.: WO2015/186498
PCT Pub. Date: Dec. 10, 2015

(65) Prior Publication Data

US 2017/0054256 A1 Feb. 23, 2017

(30) Foreign Application Priority Data

Jun. 2, 2014 (JP) ..... 2014-114208
Aug. 29, 2014 (JP) ..... 2014-175531

(51) Int. Cl.
*H01R 13/648* (2006.01)
*H01R 13/6583* (2011.01)
(Continued)

(52) U.S. Cl.
CPC ..... *H01R 13/6583* (2013.01); *H01R 13/17* (2013.01); *H01R 13/502* (2013.01);
(Continued)

(58) Field of Classification Search
CPC ..... H01R 13/65802; H01R 13/6583; H01R 13/6582; H01R 13/6581; H01R 13/6593
(Continued)

(56) References Cited

U.S. PATENT DOCUMENTS 5,685,739 A 11/1997 Davis et al.
8,021,188 B1 9/2011 Ma et al.
(Continued)

FOREIGN PATENT DOCUMENTS

JP 05001182 U 1/1993
JP 2001501015 A 1/2001
(Continued)

OTHER PUBLICATIONS

International Search Report (ISR) and Written Opinion dated Jun. 23, 2015 issued in International Application No. PCT/JP2015/064171.
(Continued)

*Primary Examiner* — Xuong Chung Trans
(74) *Attorney, Agent, or Firm* — Holtz, Holtz & Volek PC

(57) ABSTRACT

A mating connector, that includes a mating ground portion, includes a holding member, a contact, a shell and a ground member. The holding member is formed of an insulating body defining a connection space, the contact has a contact point which is held by the holding member to be positioned in the connection space, the shell covers, at least in part, the holding member in a plane perpendicular to a front-rear direction, and the ground member is electrically connected with the shell and has a base portion positioned between the holding member and the shell. A ground spring extends from the base portion and a ground contact point to be connected to the mating ground portion, and has first, second and third
(Continued)

springs. The third spring is inward of the second spring, and supports the ground contact point to project into the connection space.

13 Claims, 9 Drawing Sheets

(51) Int. Cl.
*H01R 13/17* (2006.01)
*H01R 13/502* (2006.01)
*H01R 24/64* (2011.01)
*H01R 107/00* (2006.01)

(52) U.S. Cl.
CPC ..... *H01R 13/648* (2013.01); *H01R 24/64* (2013.01); *H01R 2107/00* (2013.01)

(58) Field of Classification Search
USPC ..... 439/607.17, 607.19, 607.04, 439/607.53–607.55
See application file for complete search history.

(56) References Cited

U.S. PATENT DOCUMENTS

| | | | | |
|---|---|---|---|---|
| 9,077,096 | B2 * | 7/2015 | Simmel | H01R 13/502 |
| 9,106,024 | B2 * | 8/2015 | Zhao | H01R 13/6594 |
| 9,106,036 | B2 * | 8/2015 | Yang | H01R 24/60 |
| 9,385,499 | B2 * | 7/2016 | Guo | H01R 43/24 |
| 9,425,560 | B1 * | 8/2016 | Su | H01R 13/506 |
| 9,478,916 | B2 * | 10/2016 | Kao | H01R 13/6593 |
| 2005/0227537 | A1 | 10/2005 | Peng | |

FOREIGN PATENT DOCUMENTS

| | | | |
|---|---|---|---|
| JP | 2011154954 | A | 8/2011 |
| JP | 2015176853 | A | 10/2015 |
| JP | 2015228345 | A | 12/2015 |

OTHER PUBLICATIONS

Japanese Office Action dated Jan. 27, 2016 issued in counterpart Japanese Application No. 2014-175531.

* cited by examiner

CONNECTOR

TECHNICAL FIELD

This invention relates to a connector comprising a ground contact point which is to be connected to a mating ground portion of a mating connector.

BACKGROUND ART

For example, Patent Document 1 discloses a connector which comprises a shell having this type of ground contact point. As shown in FIG. 17, the shell of Patent Document 1 has a folded-back portion 910, which is folded back from a front end 905 of a body portion 900, and a spring 920 extending from the folded-back portion 910. The spring 920 is provided with a ground contact point 930 which is to be brought into contact with a mating shell (not shown). In this case where the folded-back portion 910 is provided as described above, the body portion 900 does not need to be formed with a cut (opening) which is used to form the spring 920. Therefore, shielding performance of the shell is not degraded.

PRIOR ART DOCUMENTS

Patent Document(s)

Patent Document 1: JP A 2011-154954

SUMMARY OF INVENTION

Technical Problem

In the shell of Patent Document 1, a position of the ground contact point 930 is too apart from a front end of the connector. As a result, a contact (not shown) and a mating contact (not shown) might be connected to each other before the ground contact point 930 of the shell is connected to the mating shell (not shown).

It is therefore an object of the present invention to provide a connector having a structure which makes the position of the ground contact point close to the front end of the connector.

Solution to Problem

An aspect of the present invention provides a connector mateable with a mating connector along a front-rear direction, wherein the mating connector has a mating ground portion. The connector comprises a holding member, a contact, a shell and a ground member. The holding member is formed of an insulating body which defines a connection space. The contact has a contact point and is held by the holding member so that the contact point is positioned in the connection space. The shell covers, at least in part, the holding member in a perpendicular plane perpendicular to the front-rear direction. The ground member is electrically connected with the shell. The ground member has a base portion positioned between the holding member and the shell, a ground spring extending from the base portion and a ground contact point which is to be connected to the mating ground portion. The ground spring has a first spring extending rearward in the front-rear direction, a second spring extending in a lateral direction perpendicular to the front-rear direction from a rear end of the first spring and a third spring extending forward in the front-rear direction from a rear end of the second spring. The third spring is positioned inward of the second spring in an up-down direction perpendicular to both the front-rear direction and the lateral direction. The ground contact point is supported by the third spring to project into the connection space. A position of the ground spring in the front-rear direction does not overlap with another position of the contact in the front-rear direction.

Advantageous Effects of Invention

Accordingly to the present invention, the ground contact point is provided to the ground member which is other than the shell, and the ground member is electrically connected with the shell. This structure makes it possible to improve flexibility in structural design of the ground contact point and the ground spring which resiliently supports the ground contact point. More specifically, the present invention can keep an electrical function equivalent to that in a case where the ground contact point is provided to the shell, while making the ground contact point close to the front end of the connector.

In particular, the ground spring has the first spring, the second spring and the third spring, so that a relatively long spring length can be obtained as a whole within a spatially limited range in the front-rear direction. As a result, a displacement of the ground contact point can be made large, and a sufficient contact pressure against the mating ground portion can be obtained.

An appreciation of the objectives of the present invention and a more complete understanding of its structure may be had by studying the following description of the preferred embodiment and by referring to the accompanying drawings.

DESCRIPTION OF EMBODIMENTS

Figure 1:
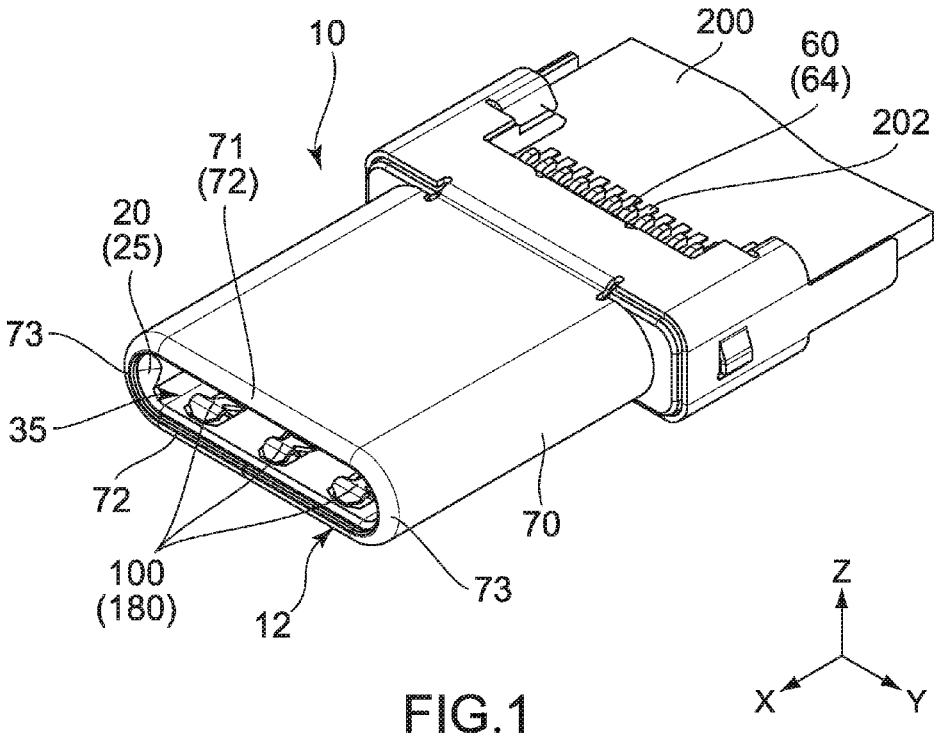
FIG. 1 is a perspective view showing a connector according to an embodiment of the present invention.

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

Referring to FIGS. 1 to 4, a connector 10 according to an embodiment of the present invention is mateable with a mating connector (not shown), which has a mating ground portion (not shown), along a front-rear direction (X-direction). As can be seen from FIGS. 1 and 2, the connector 10 according to the present embodiment has a symmetrical structure in a lateral direction (Y-direction). Moreover, as can be seen from FIG. 4, the connector 10 has a symmetrical structure in an up-down direction (Z-direction).

Figure 3:
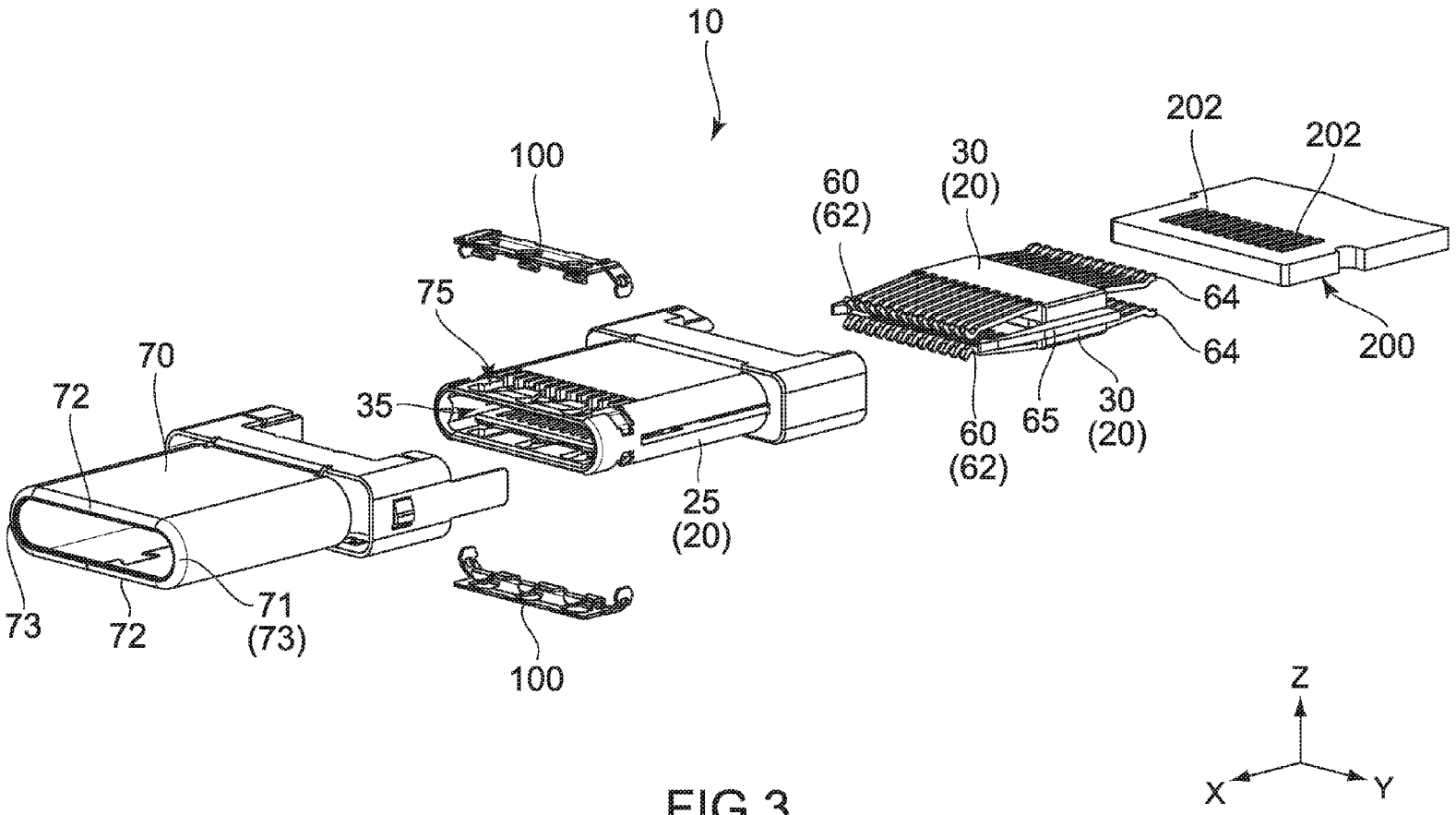
FIG. 3 is an exploded, perspective view showing the connector of FIG. 1.

As shown in FIG. 3, the connector 10 comprises a holding member 20, a plurality of contacts 60 each made of conductor, a ground plate 65 made of conductor, a shell 70 made of metal and two ground members 100 each made of conductor.

Figure 4:
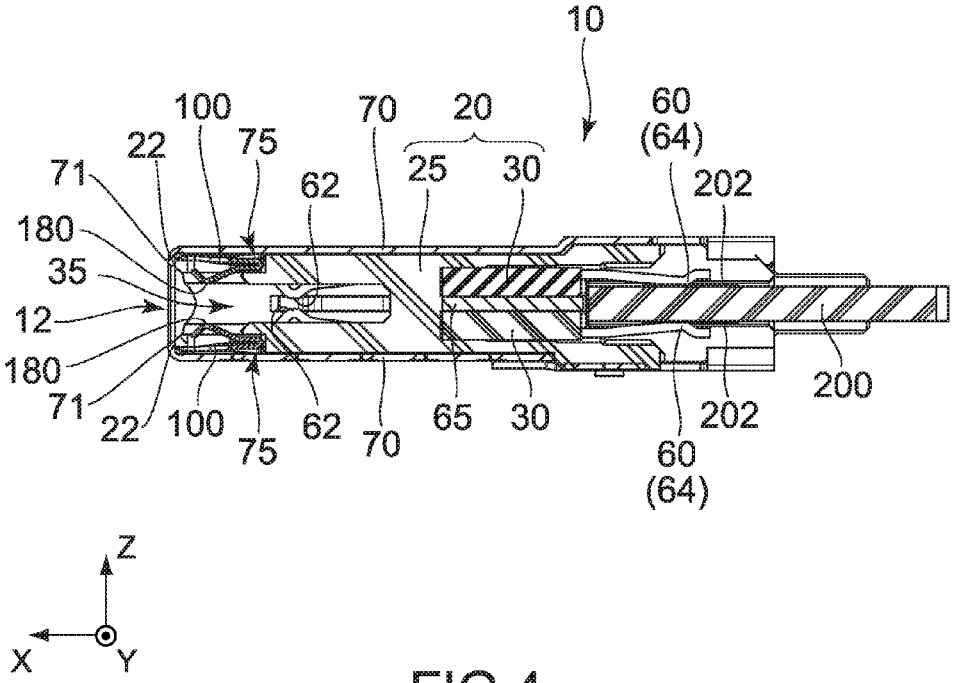
FIG. 4 is a cross-sectional view showing the connector of FIG. 2, taken along line D-D.

As can be seen from FIGS. 3 and 4, the holding member 20 has a front end 22 in the front-rear direction and comprises a primary member 25 made of insulator and secondary members 30 each of which is made of insulator and accommodated in the primary member 25. In the present embodiment, the number of the secondary members 30 is two. Therefore, the holding member 20 of the present embodiment is formed of the three members. However, the present invention is not limited thereto. For example, the holding member 20 may be formed of a single member.

Figure 5:
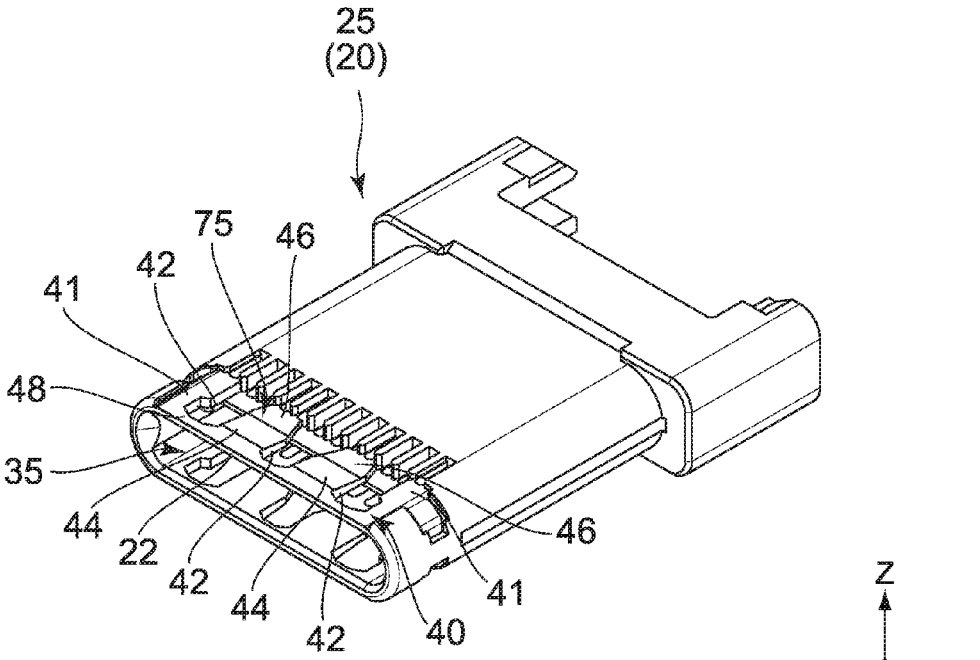
FIG. 5 is a perspective view showing a primary member of a holding member of FIG. 3.

As shown in FIG. 5, the primary member 25 of the holding member 20 defines a connection space 35. As shown in FIGS. 1 and 4, the connection space 35 opens at a front end 12 of the connector 10.

Figure 10:
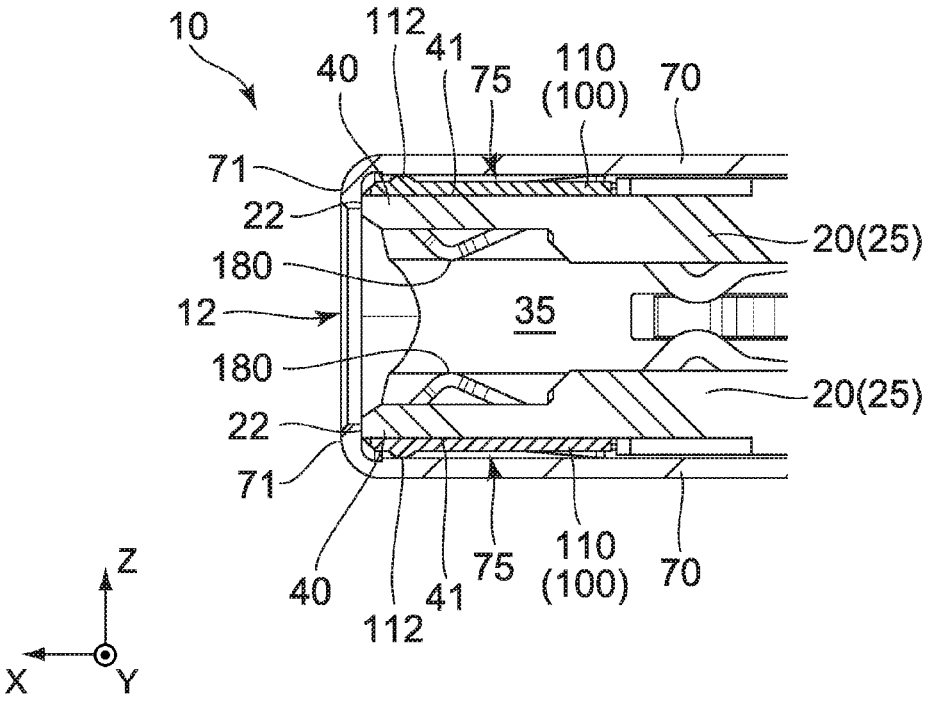
FIG. 10 is an enlarged, cross-sectional view showing a part of the connector of FIG. 2, taken along line A-A.
Figure 11:
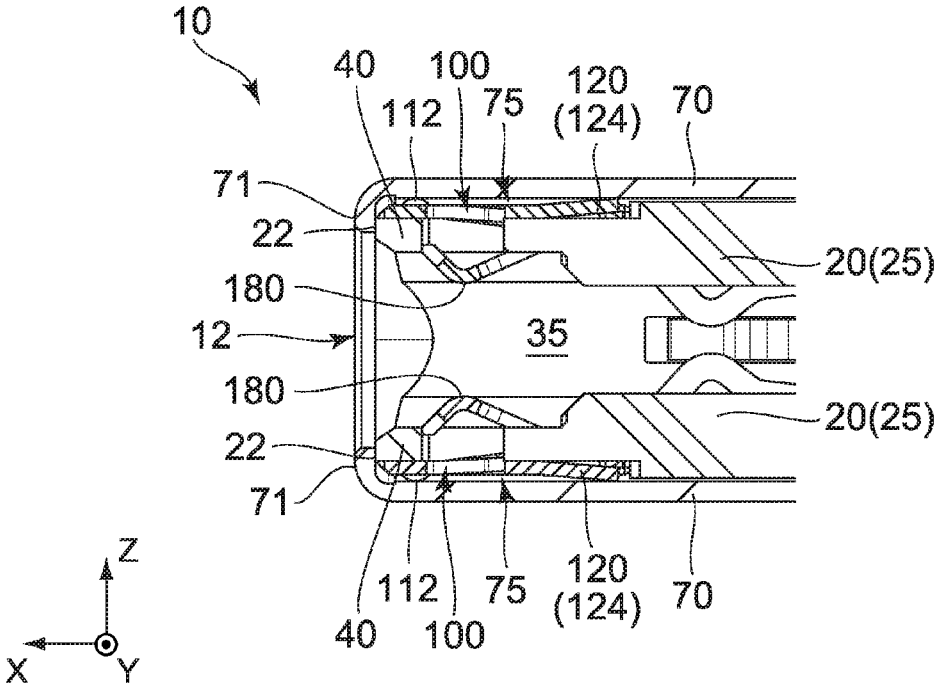
FIG. 11 is an enlarged, cross-sectional view showing a part of the connector of FIG. 2, taken along line B-B.
Figure 13:
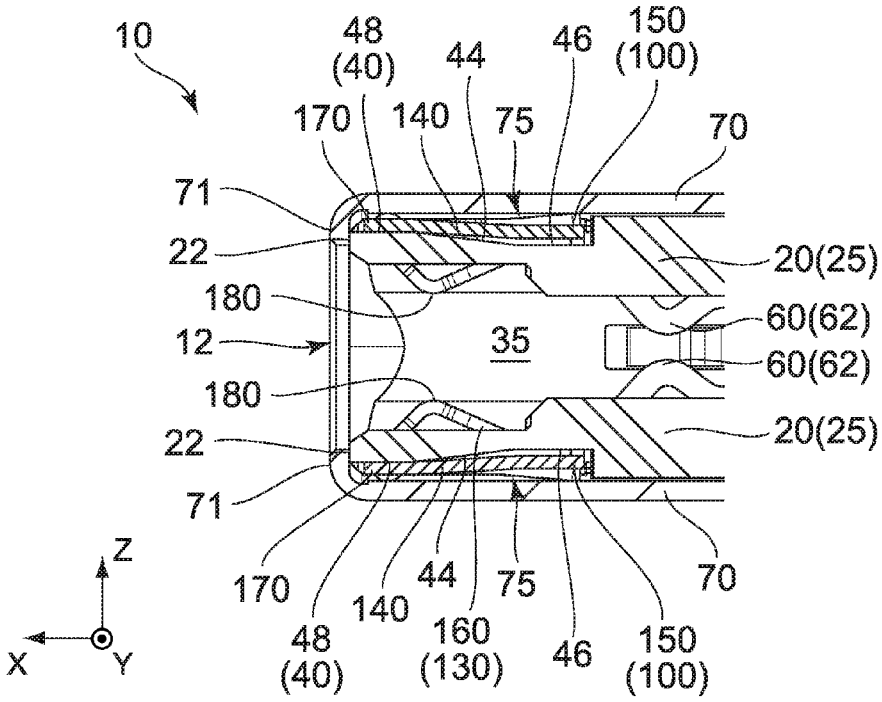
FIG. 13 is an enlarged, cross-sectional view showing a part of the connector of FIG. 2, taken along line D-D.
Figure 14:
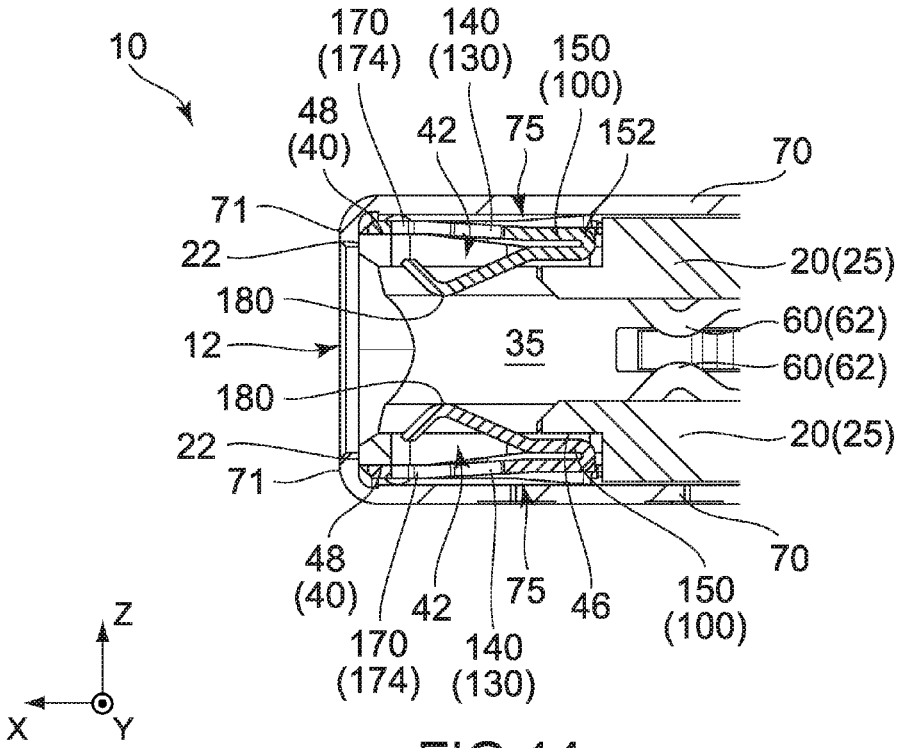
FIG. 14 is an enlarged, cross-sectional view showing a part of the connector of FIG. 2, taken along line E-E.

Referring to FIG. 5, the primary member 25 is formed with two separation walls 40. Each of the separation walls 40 of the primary member 25 is formed with three openings 42 each of which passes through the separation wall 40 in the up-down direction. As shown in FIGS. 11 and 14, a ground accommodation portion 75 is formed between each of the separation walls 40 (holding member 20) and the shell 70. Thus, each of the separation walls 40 separates the corresponding ground accommodation portion 75 and the connection space 35 from each other. As shown in FIG. 5, each of the separation walls 40 has two reference surfaces 41, two first regulation portions 44, two second regulation portions 46 and one additional regulation portion 48. As shown in FIG. 10, the reference surfaces 41 form a plane perpendicular to the up-down direction. Similarly, as shown in FIG. 13, the second regulation portions 46 form a plane perpendicular to the up-down direction, and, as shown in FIG. 14, the additional regulation portion 48 form a plane perpendicular to the up-down direction. The second regulation portions 46 are positioned inward of the additional regulation portion 48 in the up-down direction. As shown in FIG. 5, the reference surfaces 41 and the additional regulation portion 48 according to the present embodiment form a common plane. Each of the first regulation portions 44 is positioned between two of the openings 42 in the lateral direction. As shown in FIG. 13, the first regulation portion 44 couples the second regulation portion 46 and the additional regulation portion 48 to each other. The first regulation portion 44 obliquely extends so as to extend inward in the up-down direction and to extend rearward, or toward the negative X-side. In other words, the first regulation portion 44 forms an oblique plane oblique to the front-rear direction.

As shown in FIGS. 3 and 4, each of the contacts 60 has a contact point 62, which is to be connected to a mating contact point (not shown) of the mating connector (not shown), and a connection portion 64. As can be seen from FIGS. 1 and 4, the connection portions 64 are connected to pads 202 of a relay board 200, respectively. For example, the relay board 200 is connected to a cable.

Figure 12:
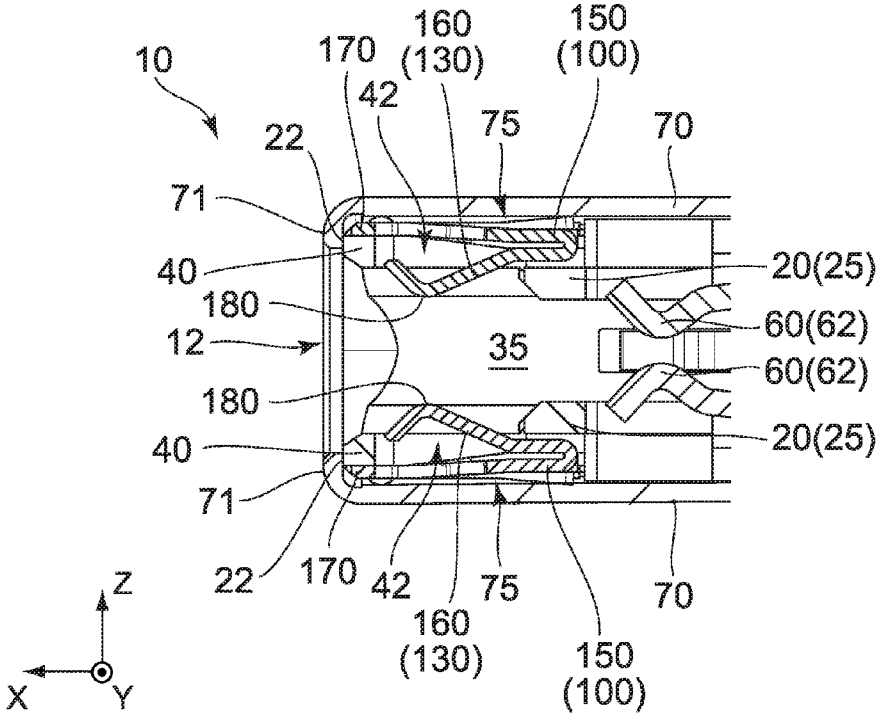
FIG. 12 is an enlarged, cross-sectional view showing a part of the connector of FIG. 2, taken along line C-C.

As can be seen from FIG. 3, the plurality of the contacts 60 are separated into two groups. The two groups are held by the secondary members 30, respectively. The contacts 60 in each group are arranged in the lateral direction (pitch direction). The ground plate 65 is sandwiched by the two secondary members 30 in the up-down direction. The ground plate 65 of the present embodiment is integrally formed with lock springs each having a lock portion which is to lock a locked portion (not shown) of the mating connector (not shown). The secondary members 30 and the ground plate 65 are accommodated in the primary member 25 while each of the secondary members 30 holds the contacts 60. As a result, as shown in FIGS. 4, 12 and 13, the contact points 62 are positioned in the connection space 35.

As can be seen from FIGS. 1 and 4, the shell 70 covers, at least in part, the holding member 20 in a perpendicular plane (YZ-plane) perpendicular to the front-rear direction. As can be seen from FIGS. 4 and 10 to 14, the shell 70 has a front portion 71 in the front-rear direction. The front portion 71 covers, at least in part, the front end 22 of the holding member 20 in the front-rear direction and protects the front end 22 of the holding member 20.

Figure 2:
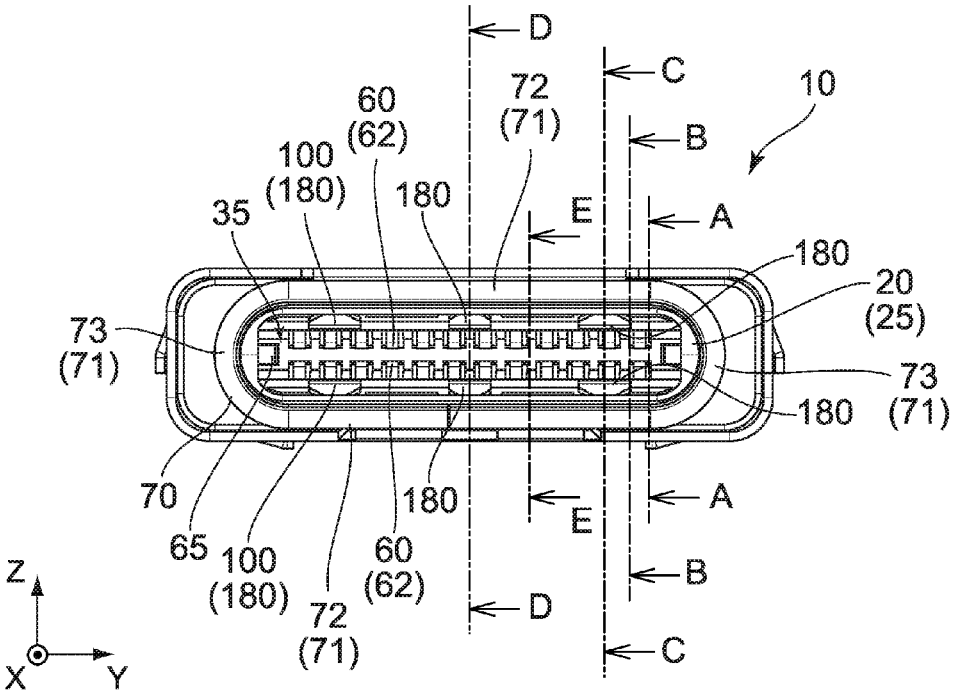
FIG. 2 is a front view showing the connector of FIG. 1.

As shown in FIG. 2, the front portion 71 has two straight portions 72 and two curved portions 73. Each of the straight portions 72 extend in the lateral direction. The two straight portions 72 are apart from each other in the up-down direction. Each of the curved portions 73 is curved in the perpendicular plane. The curved portions 73 are positioned at opposite ends of the front portion 71 in the lateral direction, respectively. Each of the curved portions 73 couples the two straight portions 72 to each other.

Figure 6:
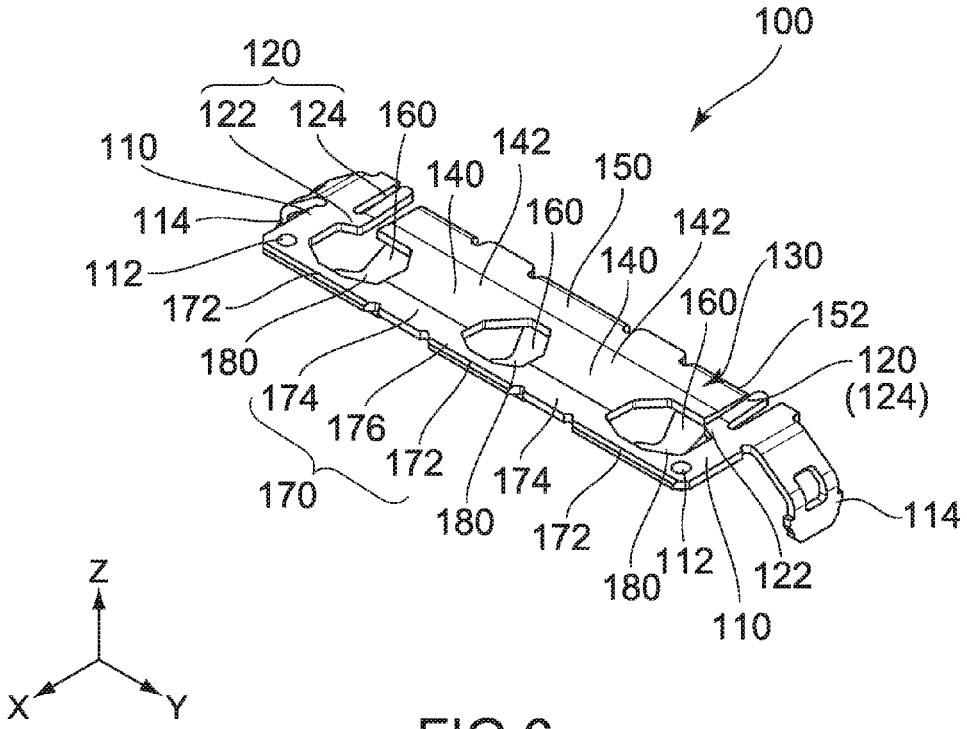
FIG. 6 is a perspective view showing a ground member of FIG. 3.
Figure 9:
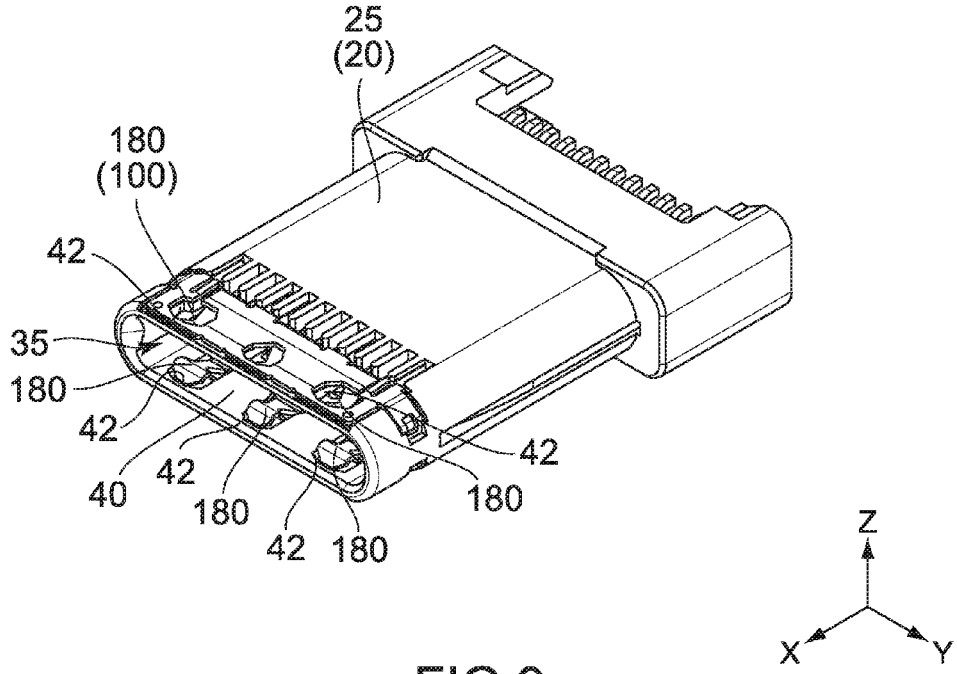
FIG. 9 is a perspective view showing the primary member of the holding member and the ground member of FIG. 3.

As can be seen from FIGS. 5, 6 and 9, the ground members 100 are mounted on the separation walls 40, respectively. As can be seen from FIGS. 1 and 4, the shell 70 is attached to the holding member 20 under a state where the ground members 100 are mounted on the separation walls 40. As can be seen from FIGS. 4, 11 and 14, each of the ground members 100 is partially accommodated in the corresponding ground accommodation portion 75.

Figure 7:
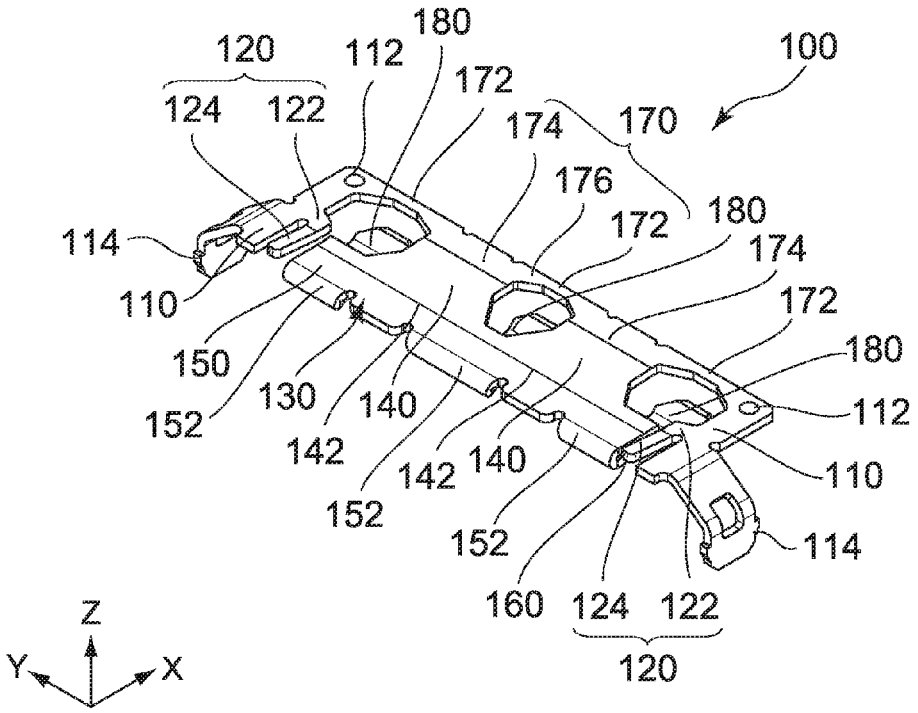
FIG. 7 is another perspective view showing the ground member of FIG. 6.
Figure 8:
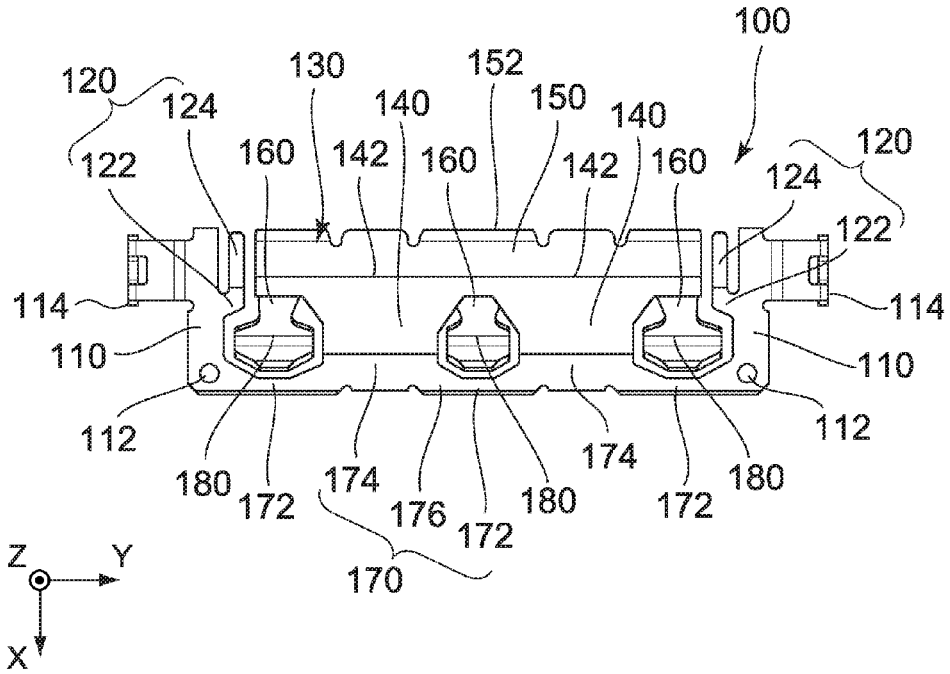
FIG. 8 is a top view showing the ground member of FIG. 6.

As shown in FIGS. 6 to 8, each of the ground members 100 of the present embodiment has two base portions 110, two spring pieces 120, a ground spring 130 and three ground contact points 180, wherein the spring pieces 120 extend from the two base portions 110, respectively, the ground spring 130 is separated from the spring pieces 120 and extends between the base portions 110, and each of the ground contact points 180 is to be connected to a mating ground portion (not shown) of the mating connector (not shown). The ground spring 130 has an additional spring 170 coupling the two base portions 110 to each other, two first springs 140, one second spring 150 and three third springs 160. The ground contact points 180 are supported by the third springs 160, respectively.

As shown in FIGS. 6 to 8, the two base portions 110 are apart from each other in the lateral direction. Each of the base portions 110 has a narrow plate-like shape extending in the front-rear direction. Each of the base portions 110 is provided with a regulated portion 112 and a press-fit portion 114 which is press-fit in the primary member 25 (see FIG. 5). The press-fit portion 114 extends from the base portion 110. The regulated portion 112 of the present embodiment is a projection which projects outward in the up-down direction. As shown in FIG. 10, the base portions 110 are mounted on the reference surfaces 41 of the separation wall 40, respectively, and positioned between the holding member 20 and the shell 70. The shell 70 and the holding member 20 sandwich the regulated portions 112 therebetween to regulate movements of the regulated portions 112, so that the base portions 110 are pressed against the reference surfaces 41, respectively.

As shown in FIGS. 6 to 8, each of the spring pieces 120 has an L-like shape formed of a short portion 122 and a long portion 124, and extends from the corresponding base portion 110 in the lateral direction. In detail, the short portion 122 extends from the base portion 110 in the lateral direction, and the long portion 124 obliquely extends rearward from the short portion 122. As shown in FIG. 11, the long portion 124 of the spring piece 120 is pressed against the shell 70 and electrically connected with the shell 70.

As shown in FIGS. 6 to 8, the additional spring 170 couples the two base portions 110 to each other in the lateral direction. In other words, the additional spring 170 extends between the base portions 110 in the lateral direction. As can be seen from FIGS. 5, 9 and 14, the additional spring 170 is positioned on the additional regulation portion 48. There is a gap provided between the additional spring 170 and the shell 70 under a state where the additional spring 170 is arranged on the additional regulation portion 48. In the up-down direction, a distance between the additional regulation portion 48 and the shell 70 is larger than a size (thickness) of the additional spring 170. Therefore, the additional spring 170 of the present embodiment can be bent between the shell 70 and the additional regulation portion 48 so as to show its spring property.

As shown in FIGS. 6 to 8, in the lateral direction, the two first springs 140 are positioned between the two base portions 110 and are apart from each other. Each of the first springs 140 extends rearward in the front-rear direction, or extends in the negative X-direction, from a second front end portion 174 of the additional spring 170. In other words, each of the second front end portions 174 is a front end, or the positive X-side end, of the corresponding first spring 140. As shown in FIG. 13, the first springs 140 are positioned on the first regulation portions 44, respectively. Each of the first regulation portions 44 regulates an inward movement of the corresponding first spring 140 in the up-down direction.

As shown in FIGS. 6 to 8, the second spring 150 extends in the lateral direction and couples rear ends 142, or the negative X-side ends, of the two first springs 140 to each other. In other words, the second spring 150 extends in the lateral direction from each of the rear ends 142 of the first springs 140. As shown in FIG. 13, the second spring 150 is positioned outward of each of the second regulation portions 46 in the up-down direction. The second regulation portions 46 regulate an inward movement of the second spring 150 in the up-down direction.

As shown in FIGS. 6 to 8, one of the three third springs 160 is positioned between the two first springs 140 in the lateral direction, and remaining two are positioned outward of the two first springs 140 in the lateral direction. Each of the third springs 160 is positioned inward of the second spring 150 in the up-down direction and extends forward in the front-rear direction, or extends in the positive X-direction, from a rear end 152 of the second spring 150. Since each of the third springs 160 extends forward not from a front end but from the rear end 152 of the second spring 150, each of the third springs 160 can be made longer. As shown in FIG. 12, each of the third springs 160 extends into the connection space 35 through the corresponding opening 42. As a result, the ground contact points 180 are supported by the third springs 160, respectively, to project into the connection space 35.

In the present embodiment, at least the first springs 140, the second spring 150 and the base portions 110 are accommodated in the ground accommodation portion 75 (see FIGS. 10 and 14), and each set of the third spring 160 and the ground contact point 180 is arranged to correspond to one of the openings 42 (see FIGS. 9 and 12). However, the present invention is not limited thereto. For example, the separation wall 40 may be provided with no portion which works as the first regulation portion 44 or the second regulation portion 46, and each of the openings 42 may be widely formed. In this structure, each of the first springs 140 and the second spring 150 may be formed to face the connection space 35 (see FIG. 14).

As can be seen from FIG. 14, in the up-down direction, a size (thickness) of each of the first springs 140 is smaller than a gap between the separation wall 40 and the shell 70, so that each of the first springs 140 can be bent between the separation wall 40 and the shell 70. As can be seen from FIG. 13, in the up-down direction, a size (thickness) of the second spring 150 is smaller than a gap between the separation wall 40 and the shell 70, so that the second spring 150 can be bent between the separation wall 40 and the shell 70. As can be seen from FIG. 12, each of the third springs 160 extends in the opening 42, so that each of the third springs 160 can be bent. The ground spring 130 has the first springs 140, the second spring 150 and the third springs 160, which are thus-formed, so that the ground spring 130 can work as a superior spring. In other words, for each of the ground contact points 180, the ground spring 130 has at least a spring length which depends on the first spring 140, the second spring 150 and the third spring 160. According to the present embodiment, a long spring length can be obtained within a limited space in the front-rear direction. In particular, since the ground spring 130 of the present embodiment further comprises the additional spring 170 having spring property, a much longer spring length can be obtained in comparison with a case where the ground spring 130 merely includes the first spring 140, the second spring 150 and the third spring 160. Therefore, a displacement of the ground contact point 180 becomes larger, and a larger contact force can be obtained.

As shown in FIG. 13, in the up-down direction, the second spring 150 (i.e. the rear end 142 of the first spring 140) is positioned between a front end (the second front end portion 174) of the first spring 140 and the ground contact point 180. In other words, the second spring 150 is positioned inward of the front end of the first spring 140 in the up-down direction. Therefore, a relatively large space is formed outward of the second spring 150 in the up-down direction. The aforementioned space not only allows the second spring 150 itself to be bent but also allows the first spring 140 to be bent largely. Thus, the displacement of the ground contact point 180 further becomes larger, and a further larger contact force can be obtained in comparison with a case where the front end (the second front end portion 174) of the first spring 140 and the rear end 142 are positioned at the same position in the up-down direction.

As can be seen from FIG. 12, a position of the ground member 100 in the front-rear direction does not overlap with another position of the contact 60 in the front-rear direction. In other words, the ground member 100 and the contact 60 are arranged at positions different from each other in the front-rear direction. In detail, in a transparent view in which the ground member 100 and the contact 60 are seen along a perpendicular direction (Y-direction or Z-direction) perpendicular to the front-rear direction while the components other than the ground member 100 and the contact 60 are made transparent, the ground member 100 and the contact 60 are not overlap with each other. Therefore, the ground spring 130 is not brought into contact with the contact 60 no matter how large the ground spring 130 is deformed.

However, in a case where the contacts 60 includes a ground contact, the ground contact may be arranged at a position same as that of the ground member 100 in the front-rear direction. For example, in a case where a position of the base portion 110 in the lateral direction is equal to a position of the ground contact in the lateral direction, a position of the base portion 110 in the front-rear direction may be overlap with a position of the ground contact in the front-rear direction. However, from a view point of securely preventing the ground spring 130 from being brought into contact with the contact 60, the position of the ground spring 130 in the front-rear direction is desired not to overlap with the position of the contact 60 in the front-rear direction even in this case. In other words, the ground spring 130 and the contact 60 are desired to be arranged at positions different from each other in the front-rear direction. According to this arrangement, in a transparent view in which the ground spring 130 and the contact 60 are seen along the perpendicular direction (Y-direction or Z-direction) perpendicular to the front-rear direction while the components other than the ground member 100 and the contact 60 are made transparent, the ground spring 130 and the contact 60 do not overlap with each other.

The present invention is not limited the aforementioned specification but can be variously modified as explained below.

Although the ground member 100 of the aforementioned embodiment includes the additional spring 170, the ground member 100 may have no function of the additional spring 170. For example, the additional spring 170 may be fixed between the shell 70 and the holding member 20 so that the additional spring 170 has no spring property. More specifically, the regulated portion 112 may be provided to the second front end portion 174, so that the additional spring 170 may be used as a part of the base portion 110.

The additional spring 170 of the aforementioned embodiment has a meander shape. However, in a case where a sufficient space is provided in the front-rear direction, the additional spring 170 may be shaped in a straight shape, and a front wall may have a constant thickness.

Figure 15:
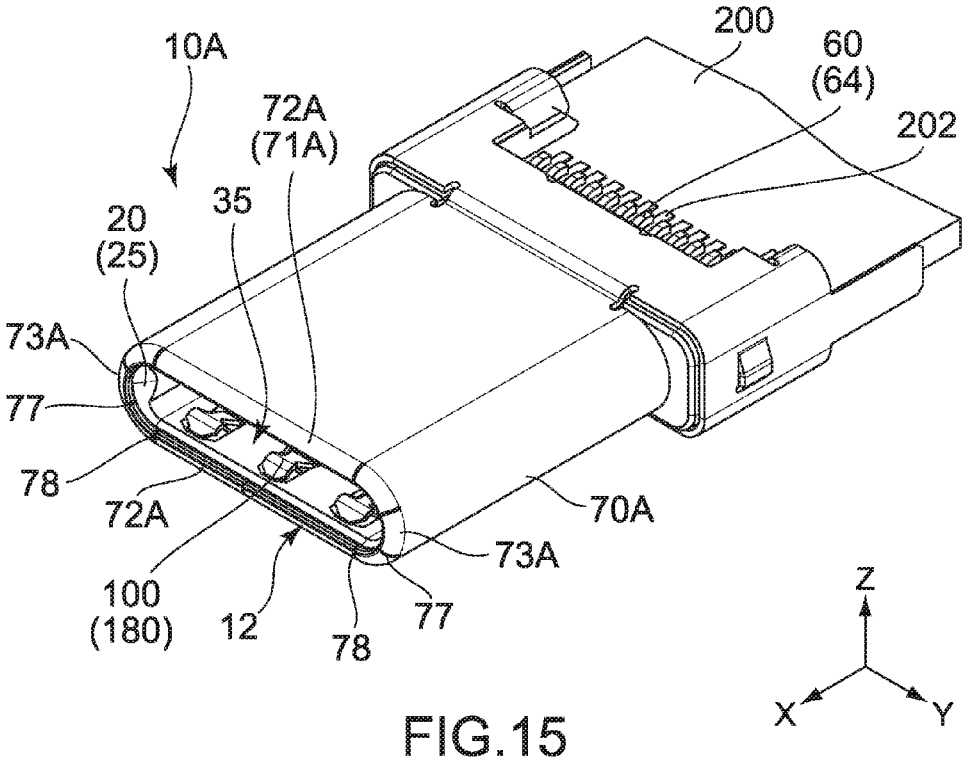
FIG. 15 is a perspective view showing a modification of the connector of FIG. 1.
Figure 16:
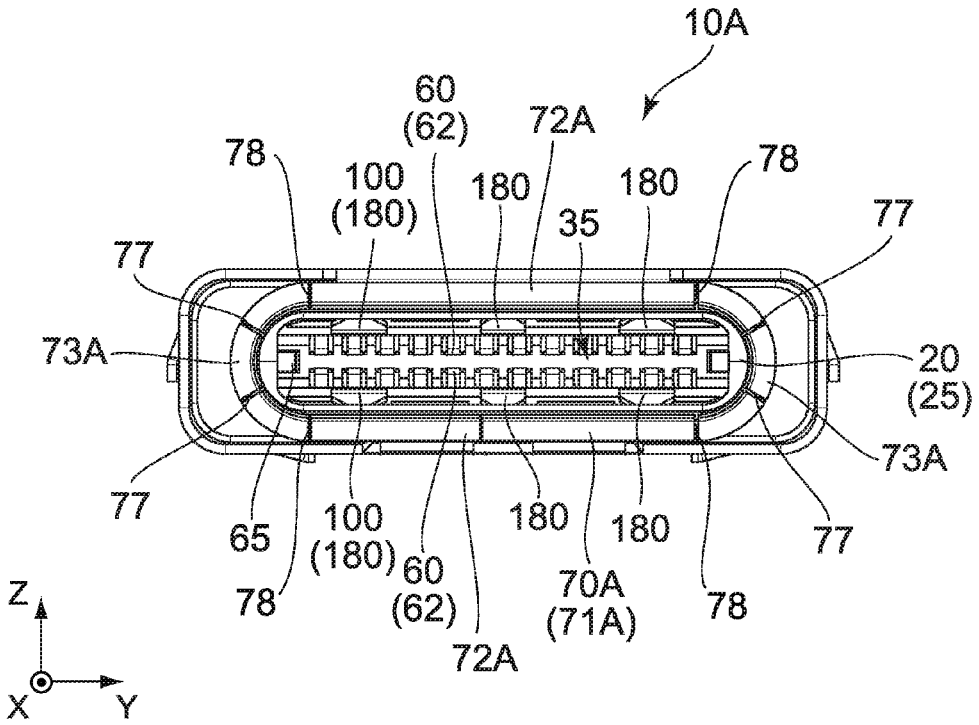
FIG. 16 is a front view showing the connector of FIG. 15.
Figure 17:
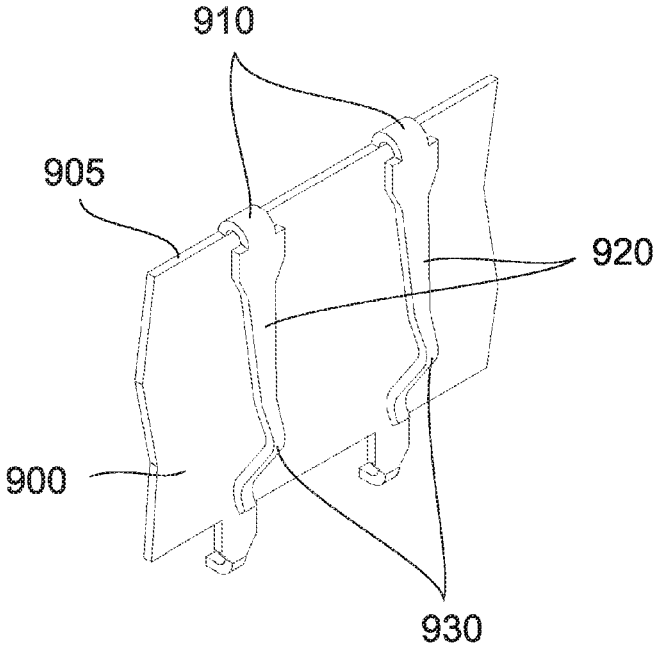
FIG.17 PRIOR ART
FIG. 17 is a perspective view showing a part of a shell of Patent Document 1.

Moreover, the shell 70 of the connector 10 of the aforementioned embodiment may be modified as shown in FIGS. 15 and 16. Referring to FIGS. 15 and 16, a shell 70A of a connector 10A according to a modification has a front portion 71A. The front portion 71A has a plurality of slits 77 and 78. As shown in FIG. 16, each of the slits 77 and 78 links inside and outside of the shell 70A in the perpendicular plane. Moreover, as can be seen from FIG. 15, each of the slits 77 and 78 extends rearward in the front-rear direction.

In detail, as shown in FIGS. 15 and 16, the front portion 71A has two straight portions 72A and two curved portions 73A. Each of the curved portions 73A is provided with two of the slits 77, and, for each of the curved portions 73A, boundaries between the curved portion 73A and the two straight portions 72A are provided with the slits 78, respectively. Therefore, each of the curved portions 73A is provided with the four slits 77 and 78. Since these slits 77 and 78 are provided, the curved portions 73A can be easily formed while increase in cost is avoided. The number of the slits 77 and 78 is not limited. However, from a view point of clearly separating the straight portion 72A and the curved portion 73A from each other, each boundary between the straight portion 72A and the curved portion 73A is preferred to be provided with the slit 78. Moreover, the curved portion 73A itself is preferred to include at least one of the slits 77 so that the curved portion 73A can be easily formed.

The present application is based on both a Japanese patent application of JP2014-114208 filed on Jun. 2, 2014 before the Japan Patent Office and a Japanese patent application of JP2014-175531 filed on Aug. 29, 2014 before the Japan Patent Office, the contents of which are incorporated herein by reference.

While there has been described what is believed to be the preferred embodiment of the invention, those skilled in the art will recognize that other and further modifications may be made thereto without departing from the spirit of the invention, and it is intended to claim all such embodiments that fall within the true scope of the invention.

REFERENCE SIGNS LIST

10, 10A connector
12 front end
20 holding member
22 front end
25 primary member
30 secondary member
35 connection space
40 separation wall
41 reference surface
42 opening
44 first regulation portion
46 second regulation portion
48 additional regulation portion
60 contact
62 contact point
64 connection portion
65 ground plate
70, 70A shell
71, 71A front portion
72, 72A straight portion
73, 73A curved portion
75 ground accommodation portion
77, 78 slit
100 ground member
110 base portion
112 regulated portion
114 press-fit portion
120 spring piece
122 short portion
124 long portion
130 ground spring
140 first spring
142 rear end

150 second spring
152 rear end
160 third spring
170 additional spring
172 first front end portion
174 second front end portion
176 coupling portion
180 ground contact point
200 relay board
202 pad
900 body portion
905 front end
910 folded-back portion
920 spring
930 ground contact point

The invention claimed is:

1. A connector mateable with a mating connector along a front-rear direction, the mating connector comprising a mating ground portion, wherein:

the connector comprises a holding member, a contact, a shell and a ground member;

the holding member is formed of an insulating body which defines a connection space;

the contact has a contact point and is held by the holding member so that the contact point is positioned in the connection space;

the shell covers, at least in part, the holding member in a perpendicular plane perpendicular to the front-rear direction;

the ground member is electrically connected with the shell;

the ground member has a base portion positioned between the holding member and the shell, a ground spring extending from the base portion and a ground contact point which is to be connected to the mating ground portion;

the ground spring has a first spring extending rearward in the front-rear direction, a second spring extending in a lateral direction perpendicular to the front-rear direction from a rear end of the first spring and a third spring extending forward in the front-rear direction from a rear end of the second spring;

the third spring is positioned inward of the second spring in an up-down direction perpendicular to both the front-rear direction and the lateral direction;

the ground contact point is supported by the third spring to project into the connection space; and a position of the ground spring in the front-rear direction does not overlap with another position of the contact in the front-rear direction.

2. The connector as recited in claim 1, wherein:

the holding member has a front end in the front-rear direction;

the shell has a front portion in the front-rear direction;

the front portion covers, at least in part, the front end of the holding member in the front-rear direction; and the front portion has a curved portion which is curved in the perpendicular plane.

3. The connector as recited in claim 2, wherein:

the front portion further has a plurality of slits;

the curved portion includes at least one of the slits; and each of the slits links inside and outside of the shell in the perpendicular plane and extends rearward in the front-rear direction.

4. The connector as recited in claim 1, wherein a position of the ground member in the front-rear direction does not overlap with another position of the contact in the front-rear direction.

5. The connector as recited in claim 1, wherein:

a ground accommodation portion is formed between the shell and the holding member; and at least the first spring, the second spring and the base portion are accommodated in the ground accommodation portion.

6. The connector as recited in claim 5, wherein:

the holding member is formed with a separation wall and an opening, the separation wall separating the ground accommodation portion and the connection space from each other, the opening passing through the separation wall; and the third spring and the ground contact point are arranged to correspond to the opening.

7. The connector as recited in claim 6, wherein:

the separation wall has a first regulation portion regulating a movement of the first spring and a second regulation portion regulating a movement of the second spring; and the first regulation portion obliquely extends so as to extend inward in the up-down direction and to extend rearward in the front-rear direction.

8. The connector as recited in claim 1, wherein the ground member is further provided with a spring piece which is pressed against the shell.

9. The connector as recited in claim 8, wherein:

the base portion extends in the front-rear direction; and the spring piece has an L-like shape and extends from the base portion in the lateral direction.

10. The connector as recited in claim 1, wherein:

the ground spring further has an additional spring extending from the base portion in the lateral direction; and the first spring extends rearward from the additional spring in the front-rear direction.

11. The connector as recited in claim 10, wherein:

the ground member comprises two of the base portions, two of the first springs, three of the third springs and three of the ground contact points;

the two base portions are apart from each other in the lateral direction;

the additional spring couples the two base portions to each other in the lateral direction;

the two first springs are positioned between the two base portions in the lateral direction;

one of the three third springs is positioned between the two first springs in the lateral direction, and remaining two are positioned outward of the two first springs in the lateral direction; and the three ground contact points are supported by the three third springs, respectively.

12. The connector as recited in claim 1, wherein the second spring is positioned between a front end of the first spring and the ground contact point in the up-down direction.

13. The connector as recited in claim 1, wherein the base portion is provided with a regulated portion which is sandwiched between the shell and the holding member so that a movement thereof is regulated.

* * * * *